US006155645A

United States Patent [19]

Bedrich

[11] Patent Number: 6,155,645

[45] Date of Patent: Dec. 5, 2000

[54] REST CHAIR

[76] Inventor: Achim Bedrich, Schleissheimer Str. 276, 80809 Munchen, Germany

[21] Appl. No.: 09/160,231

[22] Filed: Sep. 24, 1998

[30] Foreign Application Priority Data

Oct. 2, 1997 [DE] Germany ..... 297 17 656 U
Nov. 10, 1997 [DE] Germany ..... 297 19 935 U

[51] Int. Cl.[7] ..... A47C 7/50

[52] U.S. Cl. ..... 297/423.28; 297/344.19; 297/301.3; 297/300.3; 297/71

[58] Field of Search ..... 297/85, 344.19, 297/423.28, 301.1, 301.2, 354.12, 362.13, 423.1, 423.26, 344.18, 344.12, 344.1, 300.1, 300.2, 300.3, 302.2, 302.1

[56] References Cited

U.S. PATENT DOCUMENTS 2,953,192 9/1960 Fletcher .
3,004,791 10/1961 Schliephacke .
3,016,265 1/1962 Cobb .
3,311,407 3/1967 Horie .
4,852,939 8/1989 Krauska .
5,120,107 6/1992 Rogers, Jr. .

FOREIGN PATENT DOCUMENTS 2801307 7/1979 Germany ..... 297/85
93 08 914 of 1993 Germany .

*Primary Examiner*—Milton Nelson, Jr.
*Attorney, Agent, or Firm*—Fenwick & West LLP

[57] ABSTRACT

A rest chair comprises the following features: a seat portion is hingedly supported at a foot portion about a horizontal axis; at the seat portion a foot rest is hingedly linked around a horizontal axis from a position folded under the seat portion into an unfolded foot resting position; the arrangement is made such that the seat portion and the foot rest are pivotally adjustable in common by body pressure.

13 Claims, 9 Drawing Sheets

REST CHAIR

The present invention relates to a rest chair, which is adjustable from a sitting position into a resting position and which has a foot rest, which can be brought from a folded position into an unfolded foot rest position.

In a known rest chair of that kind, a back rest portion is progressively adjustable from a sitting position into a lying position relative to the seat portion, and a foot rest can be brought independent of the adjustment of the back rest portion from a rest position folded under the seat portion into an up-folded foot rest position (German registered utility model 93 08 914.7).

It is an object of the invention to provide a rest chair such that the user can bring conveniently the chair into a desired rest position with the foot rest being extended.

A further object of the invention is to provide a rest chair such that it can be brought into a desired rest position with the foot rest being extended by only exerting body pressure onto the seat portion.

A further object of the invention is to provide a rest chair in a manner that it can be brought from a sitting position with the foot rest being fully folder under the seat into a lying position with an unfolded foot rest only by exerting a body pressure.

In the rest chair according to the invention, the person sitting may bring the seat member and the back rest member into the desired inclined position of the seat member by only exerting body pressure with the back and posterior portion, with the unfolding the foot rest being positively coupled with the seat inclination adjustment.

Independently thereof, the inclination of the back rest may be adjustable with respect to the seat portion and the seat portion itself may be adjustable in height. Both said adjustments may be carried out preferably under support of servo power, e.g. by means of gas springs. These last mentioned adjustments may preferably be triggered by means of one single control lever.

Additionally, the seat portion may be rotationally adjustable with respect to the foot member in a manner known per se.

All adjustment positions may be infinitely controllable and blockable.

The transfer of the body pressure exerted by the person sitting by means of the posterior and the back into an inclination adjustment of the seat portion and at the same time an unfolding of the foot support into a foot support position is preferably carried out in a purely mechanical manner via rod assemblies, as they are defined in the claims.

The invention will now be described in further detail by means of schematic drawings with reference to preferred embodiments:

Figure 10:
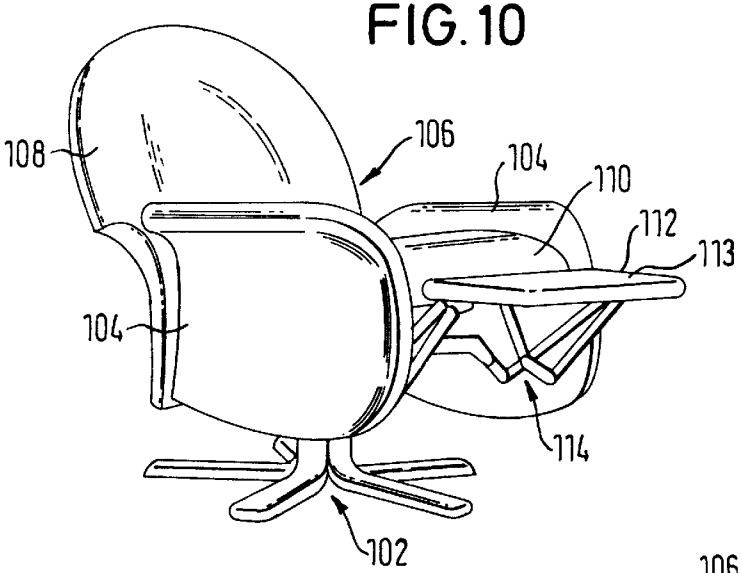
FIG. 10 shows the rest chair according to FIG. 9 in an intermediate position between sitting and lying position.
Figure 11:
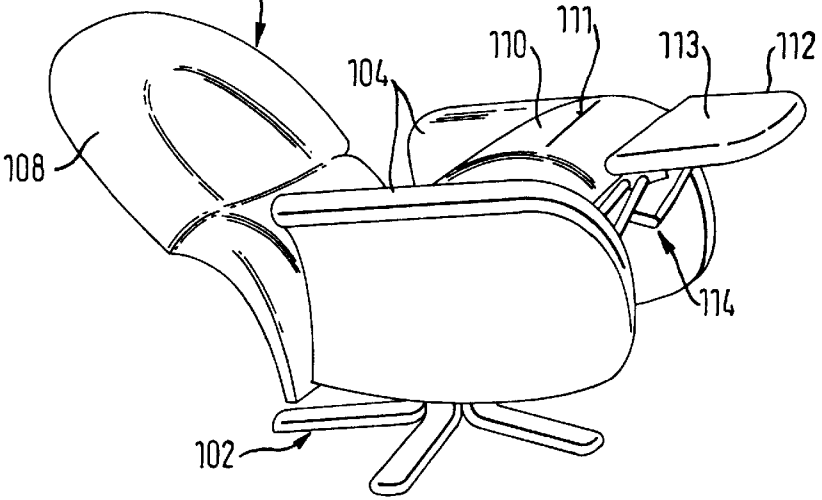
FIG. 11 shows the rest chair according to FIG. 9 in the lying position with a swung-back seat and back rest portion and an unfolded foot rest.
Figure 9:
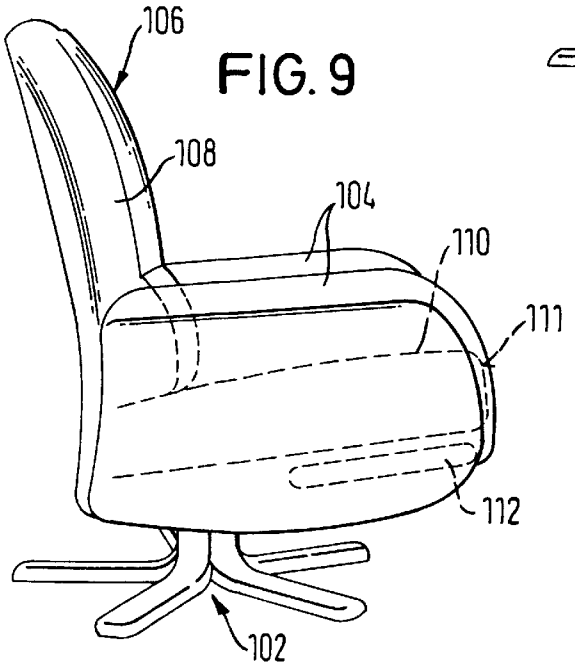
FIG. 9 shows a second preferred embodiment of a rest chair according to the invention in sitting position.
Figures 12, 13, 14:
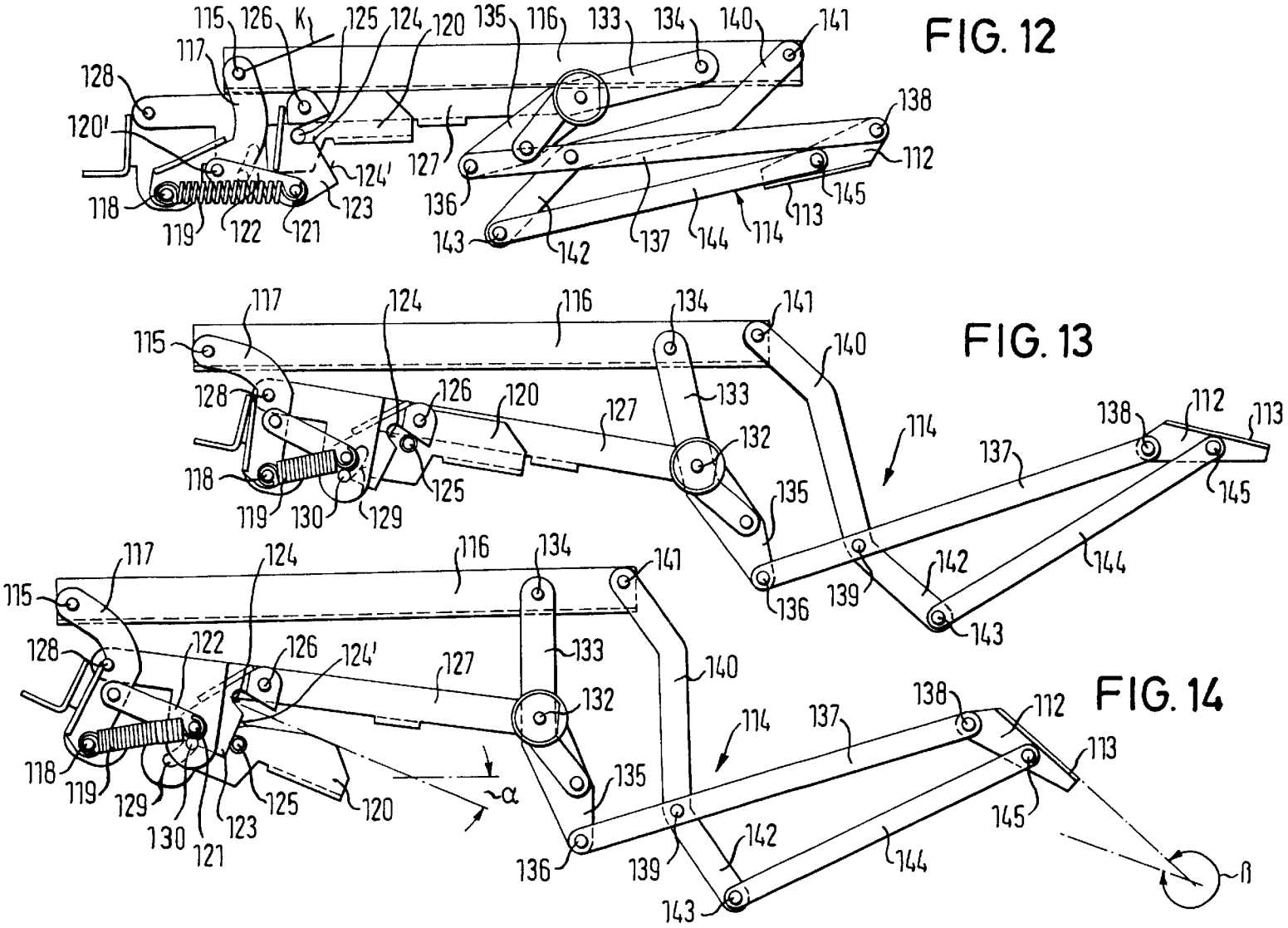

FIGS. 12, 13 14 show a rod assembly arranged between a framing and the seat and back rest portion, or the foot rest, respectively, in three different operating positions, namely FIG. 12 shows the rod assembly in the sitting position corresponding to FIG. 9;

FIG. 13 shows the rod assembly in the intermediate position corresponding to FIG. 10, and FIG. 14 shows the rod assembly in the lying position of the rest chair corresponding to FIG. 11.

The rest chair shown in FIGS. 1 to 8 has a foot member 2, a framework 20 adjustable in height with respect to the foot member and adjustable in azimuth, said framework having a pair of brackets 27 attached thereto, a seat portion 10 supported via a rod assembly or linkage 14 by the framework 20, a back rest portion 8 coupled thereto, and a foot rest 12 coupled to the seat portion 10 via the rod assembly or linkage 14.

The parts of the rod assembly or linkage 14 which will now be described and the bracket 27 exist in pairs on both sides of the rest chair, but (besides FIG. 7) they are shown in the Figures only once and are also described in this manner.

A frame 16 forming part of the seat portion 10 is connected to the bracket 27 fixed at the framework via a connecting rod 17 and via a first lever 33, 35. The coupling points of the connecting rod 17 at the frame and at the bracket are designated by 15 and 18. The coupling points of the cranked lever 33, 35 at the bracket 27 and at the frame 16 are designated by 32 and 34. The mentioned coupling points as well as other coupling points described in the following each allow rotational movement of the coupled levers or members.

A lower arm 35 of the cranked lever 33, 35 has a coupling point 36 for a first longitudinal connecting rod 37, the other end 38 of the first connecting rod being coupled to the foot rest 12. The first longitudinal connecting rod 37 has a coupling point 39 for a second lever 40, 42 at an intermediate position. The upper arm of the lever 40 is linked at 41 to the frame 16, whereas the lower arm 42 carries a coupling point 43 for a second longitudinal connecting rod 44, the other end of which also being coupled to the foot rest 12 at 45.

Figure 1:
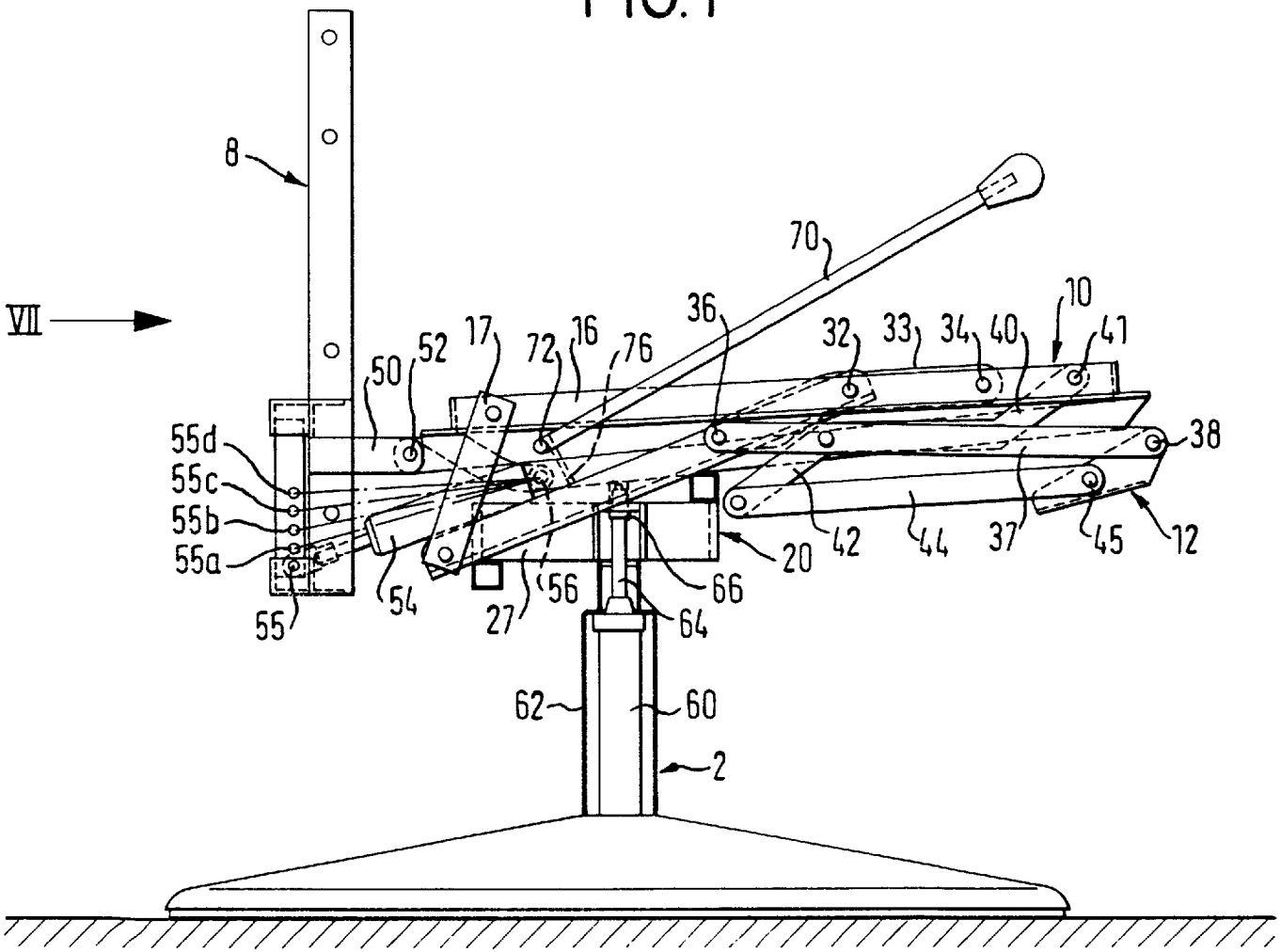
FIGS. 1 to 3 are a side elevation view of the framing of a rest chair of a first preferred embodiment according to the invention with an upright back rest member in three positions, namely in the sitting position (FIG. 1), in a partially inclined intermediate position (FIG. 2) and in a completely inclined lying position (FIG. 3)
Figure 3:
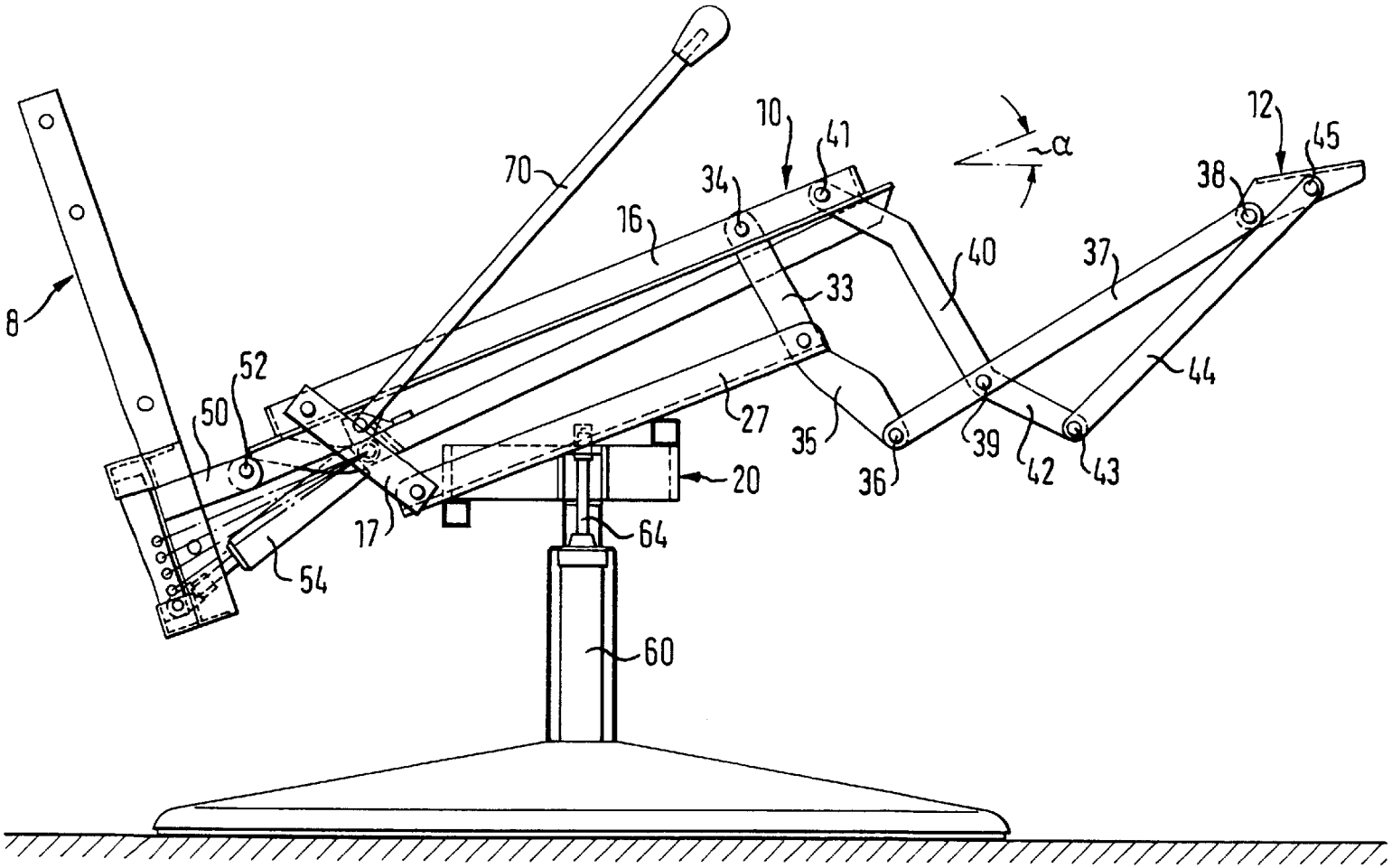

Thus, the rod assembly 14 forms a composite crank gear assembly, the first gear train of which enabling components 16; 17; 27; 33, 35 a pivot movement of the frame 16 and thereby of the seat portion 10 by an acute angle a (see FIG. 3) up to approximately 25° from the position in FIG. 1 into the position of FIG. 3 with respect to the framework 20, whereas the second gear train comprising members 16; 33, 35; 40, 42; 37, 44 moves the foot rest 12 at the same time by an obtuse angle b of up to approximately 180°. All this can be managed easily by the user by exerting a force onto the frame 16 via the seat portion 10 and the back rest portion 8 by means of his posterior and lower back portion, wherein simultaneously with the inclination adjustment of the seat portion 10, the foot rest 12 unfolds from the position folded under the seat portion in accordance with FIG. 1 into the upfolded foot rest position in accordance with FIG. 3.

The back rest portion 8 is hingedly attached at a rotary point 52 of the frame to the frame 16 via a web 50 rigidly connected to the back rest portion 8 and at 56 via a gas spring, preferably a pneumatic spring 54, wherein the foot of the pneumatic spring 54 is linked at 55 to the seat portion 8. As an alternative to this coupling point 55, coupling points designated by 55*a, b, c* and *d* are provided at the back rest portion 8, said coupling points being usable selectively in accordance with the desired basic rigidity of the pneumatic spring 54 for linking the foot member of the pneumatic spring 54.

Figure 2:
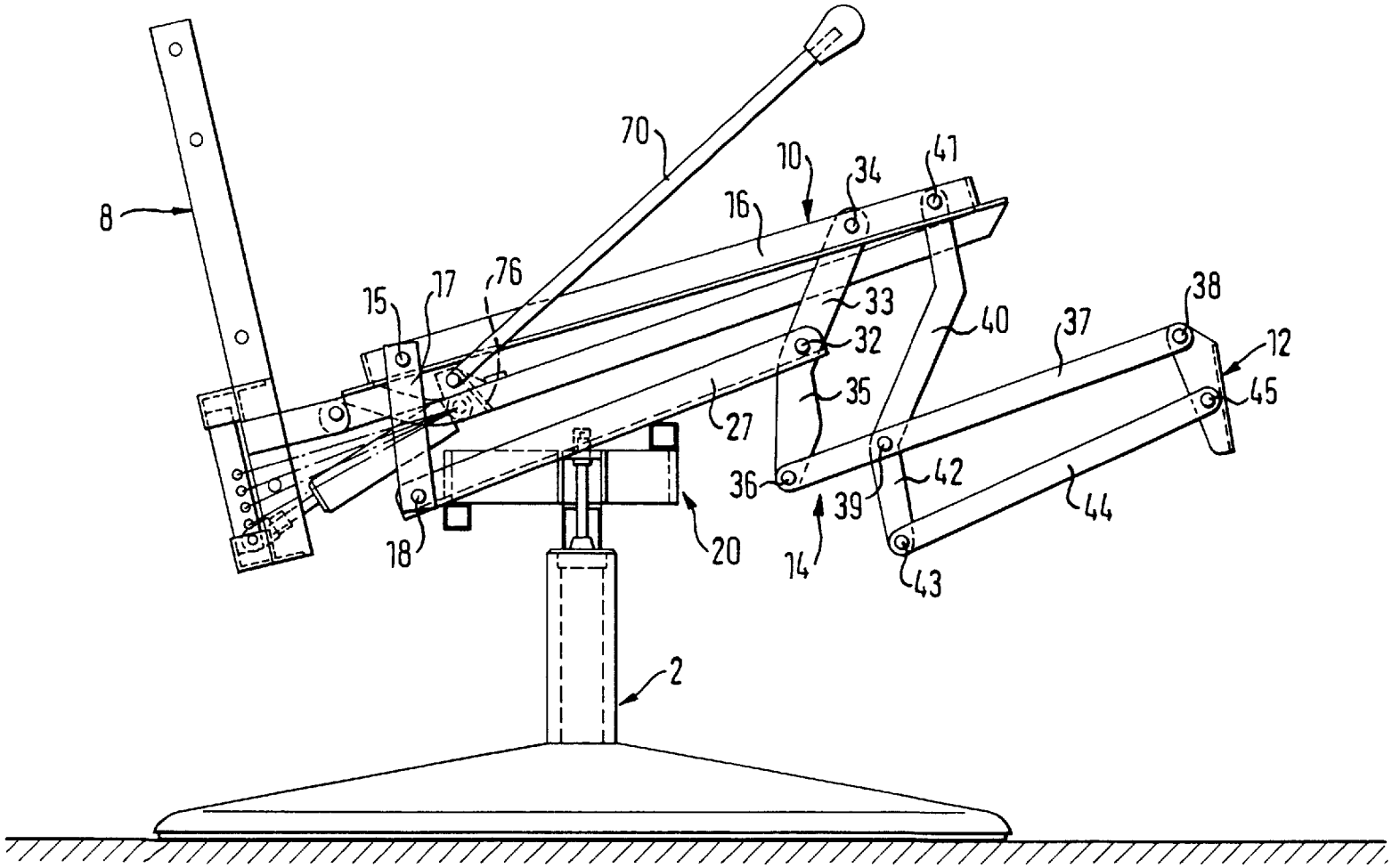

In FIG. 1, a second gas or pneumatic spring is indicated at 60 within a rigid column 62 of the foot member 2. This pneumatic spring 60 has an extendible piston rod 64, the upper end of which being fixed to the framework 20 at 66. Whereas the piston rod is shown in FIGS. 1 to 3 in a manner retracted into the foot member 2, the piston rod is shown in FIGS. 4 to 6 in a vertically extended manner, so that the framework 20 including the seat portion and the back rest portion is in an elevated position.

Both pneumatic springs 54, 60 are manually operable by means of a control lever 70 which is arranged either within or outside an arm member, which is not shown in the drawings, and which is pivotal around a horizontal axis 72 at a support bearing connected to the frame 16.

Figure 4:
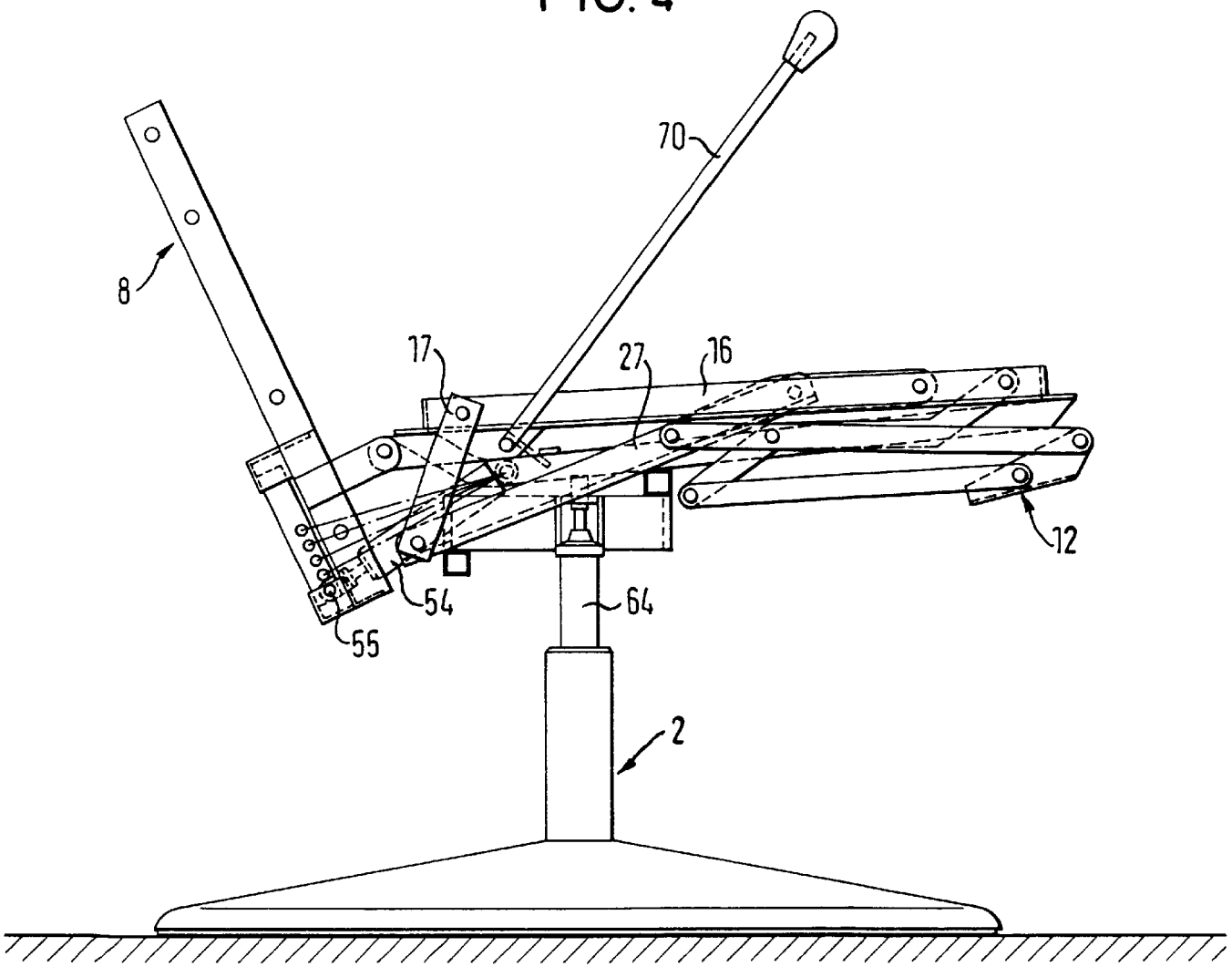
FIGS. 4 to 6 show the framing of the rest chair according to FIGS. 1 to 3 with an inclined back rest position, again in three positions, namely in a sitting position (FIG. 4), an intermediate position (FIG. 5) and a lying position 8 FIG. 6)
Figure 5:
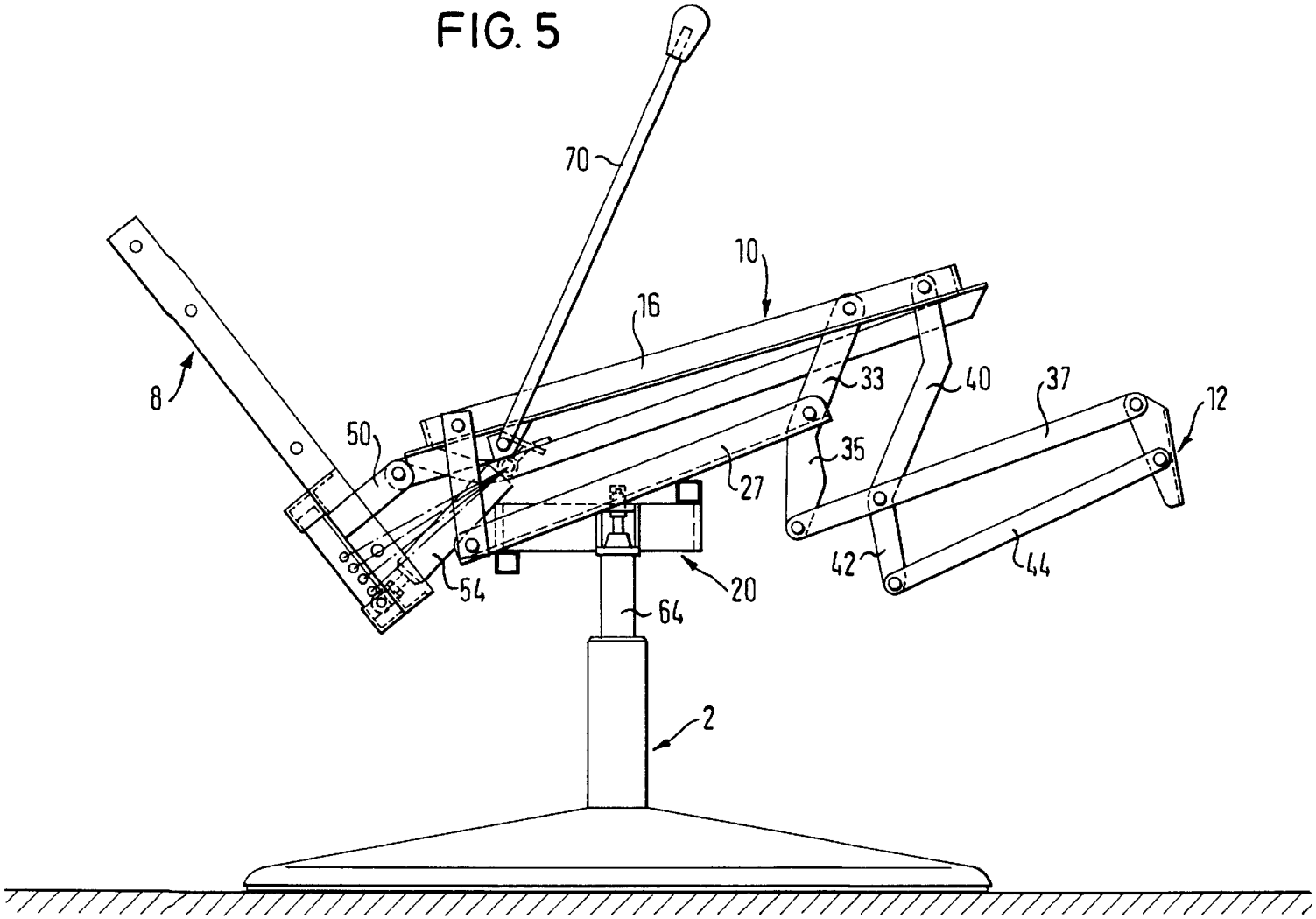

The control lever 70 carries a rod 74 close to its pivot point in the axis 72 said rod projecting transversely from the axis (FIG. 7), with a shoulder 76 attached thereto (FIG. 1, FIG. 4). This shoulder acts onto a valve at the free end of the first pneumatic spring 54. In the neutral position of the control lever 70 according to FIGS. 1 to 3, the shoulder 76 blocks the valve, so that the first pneumatic spring 54 acts like a rigid web of invariable length. Consequently, the back rest portion 8 is blocked in its inclined position towards relative to the seat portion at the angle of approximately 90° shown in FIGS. 1 to 3. If the control lever 70 is pivoted by the user of the rest chair from the neutral position downwards according to FIGS. 1 to 3, the shoulder 76 releases the valve at the free end of the first pneumatic spring 54 thus causing the pneumatic spring 54 to be unblocked so that as a result of a force exerted by the person sitting onto the back rest portion 8 it can shorten in the sense of an enlargement of the inclination angle of the back rest portion 8 relative to the seat portion 10, wherein, however, the pneumatic spring generates a counter-force with respect to the force exerted by the user, so that a smooth inclination adjustment of the back rest portion takes place.

Figure 7:
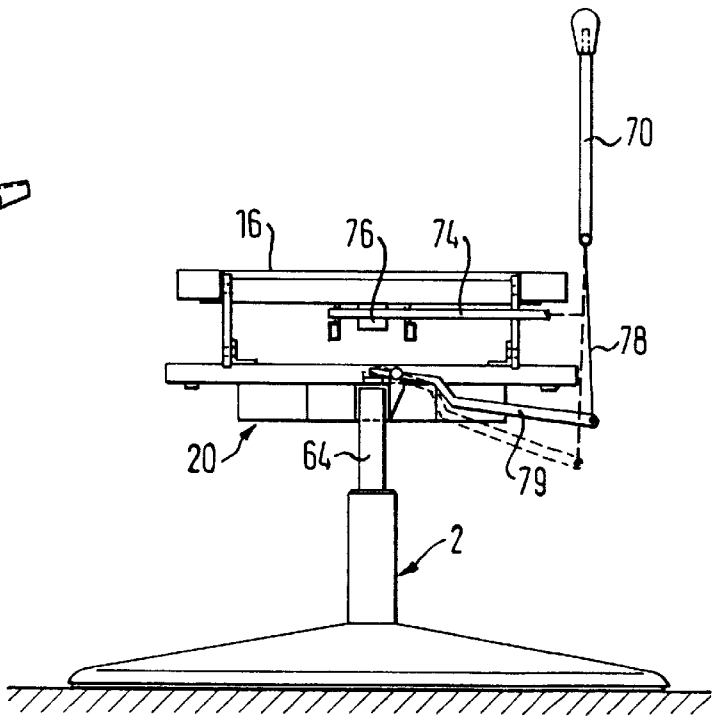
FIG. 7 is a view in the direction towards the arrow VII in FIG. 1, with portions such as the back rest portion and the foot rest next to the rod assembly not being shown for the sake of simplicity.
Figure 6:
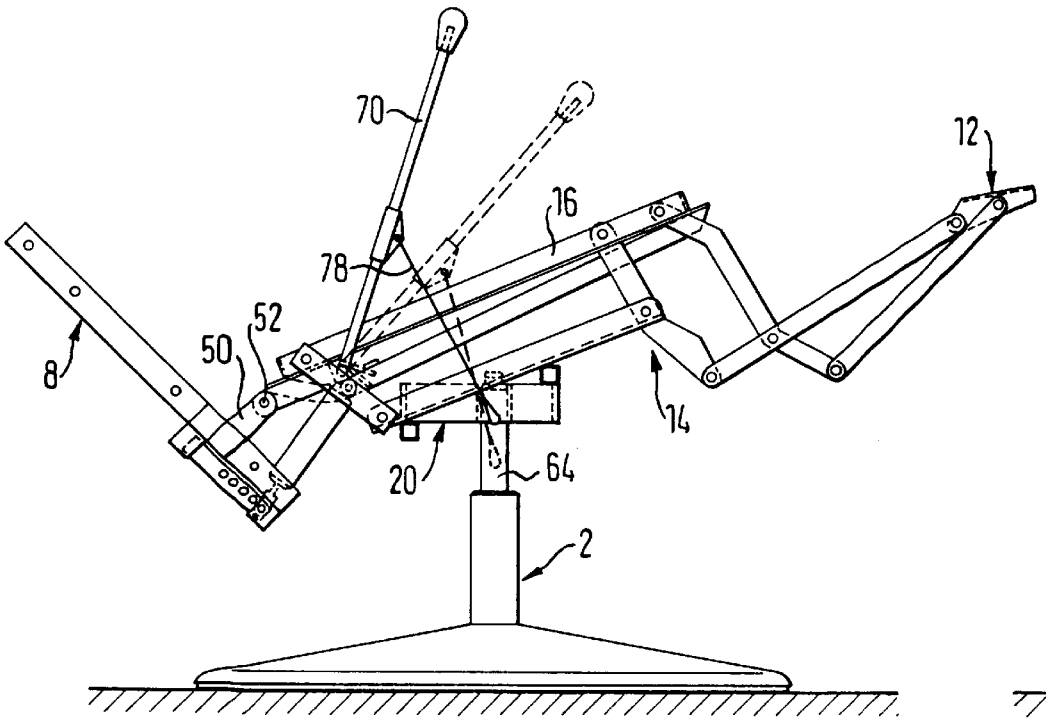

In accordance with FIGS. 6 and 7, the control lever is connected via a flexible pull member 78 to the outer end of an intermediate lever 79, the inner end of which cooperating with a valve at the free end of the piston rod 64 of the second pneumatic spring 60. The pull member 78, which can for instance be formed by a textile band, and the intermediate lever 79 are shown in FIG. 7 in a full line in a position unblocking the pneumatic spring 60, and in a dashed line in a position blocking the pneumatic spring. In the normal position of the control lever 70, drawn in FIGS. 1 to 3, the pneumatic spring 60 is also blocked as the pneumatic spring 54, thus not exerting a force onto the framework 20. In the swung-up position of the control lever shown in full line in FIG. 7, the releasing pneumatic spring exerts a force upwards onto the framework 20 so that a height adjustment of the framework 20 and therefore of the seat portion 10 is enabled.

In the manner described, the user may control the height adjustment with one and the same control lever 70 supported by the pneumatic spring 60, and, as an alternative, the back rest adjustment supported by the pneumatic spring 54.

Figure 8:
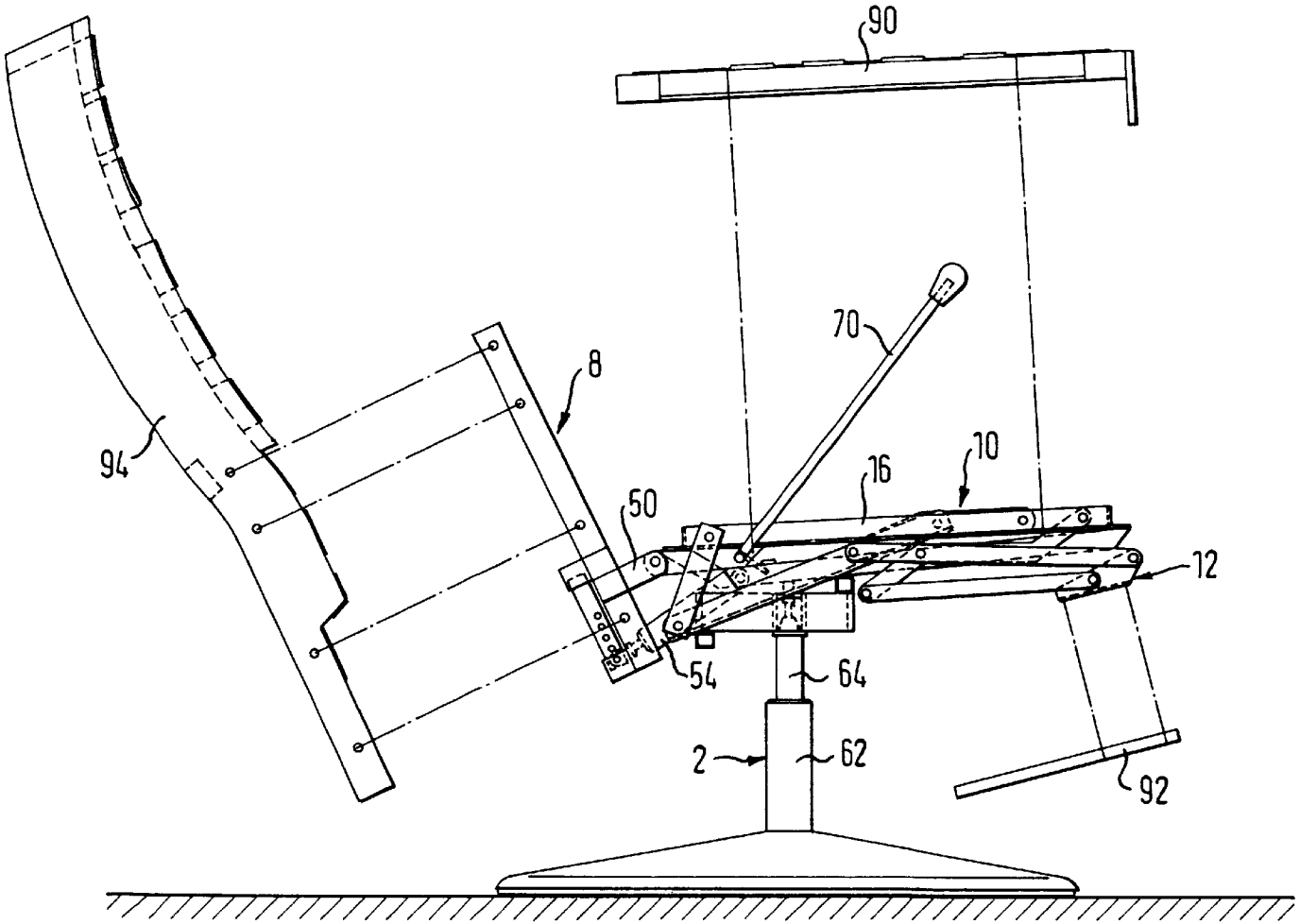
FIG. 8 is a view as FIG. 4 with supplemented portions of the rest chair in an exploded view.

FIG. 8 shows additional members in a position corresponding to that of FIG. 4. A seat plate 90 is attachable to the frame 16. A foot plate 92 is attachable to the foot rest 12. A contoured inner shell 94 is attachable to the back rest portion 8. The attachment can be made in all three cases by means of screws or rivets. Of course, seat and back rest cushions as well as arm portions are provided to complete the back rest, which are designed in the conventional manner and which are therefore not shown.

In the rest chair described, the inclination of the seat portion 10 and at the same time the position of the foot rest 12 can be easily adjusted by means of body pressure, which is exerted by the person sitting onto the rest chair with his posterior and his lower back region. When the control lever 70 is in neutral position, the height of the seat portion 10 and the inclination of the back rest portion 8 are blocked relative to the seat portion 10. By pivoting the control lever 70 from the neutral position downwards, the person sitting may unblock the back rest inclination of the back rest portion 8 by releasing the first pneumatic spring 54, thus preventing a too violent movement of the back rest portion downwards under the influence of gravity. By pivoting the control lever 70 from the neutral position upwards, the person sitting may unblock the second pneumatic spring 60 thereby enabling a height adjustment of the seat portion 10, wherein the pressure of the pneumatic spring counteracts a jerky downward movement of the seat member.

A rotational azimuthal adjustment of the rest chair according to FIGS. 1 to 8 is not described in detail; it can be additionally provided in a known manner, possibly in connection with a rotational blocking means which is also not described here.

The frame assembly of a rest chair in accordance with the second embodiment of the invention shown in FIGS. 9 to 11 has a foot member 102, two arm members 104 fixedly connected therewith through a framework 120 (FIGS. 12 to 14) and a seat and back rest portion 106 with a back rest 108 and a seat 110, which are fixedly connected to one another at an angle of 90°. Furthermore, the rest chair comprises a foot rest 112, which is unfoldable from a stowed position below the seat (FIG. 9) through a rod assembly totally designated by reference numeral 114 in an elevated support position above the sitting edge 111 of the seat.

The seat and back rest portion is fixedly connected to a frame 116, which is not shown in detail in FIGS. 9 to 11. The framework 120 is pivotally connected to the frame 116 via a linkage or rod assembly 114. The foot rest 112 is on one hand pivotally connected to the frame 116 via the rod assembly 114, and on the other hand it is pivotally connected to the framework 120.

FIGS. 12 to 14 show the structure of the rod assembly 114 in detail, which connects the frame 116 for the seat and back rest portion 106 with the framework 120 to effect the positions of the rest chair that can be seen in FIGS. 9 to 11.

The frame 116 is linked at 115 via a cranked lever 117 to a pin 118 fixed in the frame. This pin 118 serves for simultaneous holding the one end of a tensile spring 119, which is fixed with its other end at a pin 121, which pivotally connects a flap 122 coupled at 120' to the framework 120 with a cam lever 123.

The cam lever 123 has a cam recess 124 for cooperation with a cam pin 125, which is fixed to the framework 120 (FIG. 12). The other end of the cam lever 123 is hingeldy connected at 126 to a pivot arm 127. This pivot arm 127 is pivotally linked at 128 to the framework 120 at, and limited in its pivot movement by an arcuate slot 129 in which a crosshead 130 fixed to the pivot arm 127 slides. The pivot arm 127 which in the position according to FIGS. 12 and 13 is arranged in parallel to the framework is linked at 132 to the center of a cranked lever 133, 135, the upper arm 133 thereof being linked at 134 to the frame 116, whereas to its lower arm 135 at 136 the one end of the a longitudinal connecting rod 137 is linked. This first longitudinal connecting rod 137 is linked with its other end at 138 to the foot rest 112. At an intermediate position, the first longitudinal connecting rod 137 is tied up at 139 by a further cranked lever 140, 142 which is substantially parallel to the lever 133, 135 and the upper arm 140 of which being linked to the frame at 141, whereas its lower arm 142 is linked at its free end at 143 to a second longitudinal connecting rod 144. This second longitudinal connecting rod 144 is also linked at 145 to the foot rest 112. The rod assembly 114 therefore forms a composite crank gear, the first gear train of which enabling along with components 116; 117; 127; 133, 135 a pivot movement of the frame 116 and therefore of the seat and back rest portion 106 by an acute angle α with respect to the fixed framework 120, whereas the second gear train along with components 116; 133, 135; 140, 142; 137; 144; 112 moves the foot rest 112 at the same time by an obtuse angle β, by the exertion of the force by a user onto the frame 116 via the seat and back rest member 106 approximately in the direction of arrow K towards the coupling point 115 of the cranked lever 117 at the frame 116 in the rest position of FIG. 12.

Due to this force K, the cranked lever 117 is pivoted in counter-clockwise direction into the position of FIG. 13 and at the same time it is moved linearly towards the left into the position of FIG. 13. This combined movement is enhanced by a tensile spring 119 shown in FIG. 12. The cam lever 123 first of all snaps under the effect of the preload force of the tensile spring from the position latched with the cam spring 125 of FIG. 12 into the position in accordance with FIG. 13, wherein the cylindrical cam pin slides along the upper inner wall of the cam recess 124. The pivot lever 127 remains is its position parallel to the framework 120 as in FIG. 12, whereas the arrangement consisting of the flap 122 and the cam lever 123 slightly extended. Along with the pivot movement of the cranked lever 117, the cranked lever 133, 135 has turned in counter-clockwise direction around a larger angle as well as lever 140, 142, so that the first and the second connecting rod 137, 144 are spread and displaced with respect to one another in longitudinal direction such that the foot support 112 is pivoted from the position of FIG. 12 by a large obtuse angle β. If further force is exerted onto the seat and back rest portion 106, the frame 116 is erected with respect to the framework 120 into the end position of FIG. 14, totally by the acute angle α with respect to the starting position of FIG. 12. At the same time, the foot rest 112 is pivoted into its elevated position in total by the obtuse angle β with respect to the starting position of FIG. 12. In FIG. 14 the upper leg of the angle α is in parallel to the frame 116 in FIG. 14, and the lower leg of the angle β is in parallel to the rest surface 113 of the foot rest 112 in the position of FIG. 12.

The practical ranges for the angle α are between 15° and 45° and for the angle β in the range between 140° and 180°. In the embodiment shown, the angle α is approximately 25° and the angle β is approximately 155°.

If when looking at FIG. 14 it is assumed that the seat level extends approximately in parallel to the frame 116, it can be imagined by means of this Figure in which approximate position the user lies in a relaxed position on the seat surface with his back supported against the back rest, wherein the lower thighs rest in a relaxed manner on a level far above the posterior.

In the position of FIG. 14, a rest position between the cam pin 125 and a surface 124' at the cam lever 123 below the cam recess 124 is reached. In this position, the tensile spring 119 is preloaded again so that when the seat and back rest portion are subsequently put into an upright position, the tensile spring supports a force exerted opposite to the force exerted onto the frame 116 by body pressure until the rod assembly again moves back into the rest position, i.e. the sitting position of the rest chair in accordance with FIG. 9.

The features of the invention disclosed in the above description, in the drawings and in the claims may be essential individually and in any combination for realizing the invention it is various embodiments.

I claim:

1. A rest chair having a framework supported on a foot member and including a frame for holding a seat and back rest portion linkage means pivotally connecting the frame to the framework, and a foot rest pivotally linked to the frame and the framework, said linkage means supporting a seat and a back rest portion for movement by body pressure from a sitting position into an inclined reclining position, and at the same time for movement of the foot rest from a stowed position fully folded under the seat and back rest portion into an elevated supporting position, wherein the linkage means forms a composite crank gear having a first gear train which includes the frame, an angle lever linked to the framework, a pivot arm and a first lever centrally and hingedly connected to the pivot arm, one arm of the first lever being connected to the frame, and having a second gear train which includes the frame, the first lever, a first longitudinal connecting rod, and the foot rest hingedly connected to one end of each of the first and a second longitudinal connecting rod, wherein the first longitudinal connecting rod is hingedly connected at one end thereof to a rotary point of a second lever and at another end thereof to another arm of the first lever, and wherein another end of the second of the two longitudinal connecting rods is hingedly connected to another arm of the second lever.

2. A rest chair having a framework supported on a foot member and including a frame for holding a seat and back rest portion linkage means pivotally connecting the frame to the framework, and a foot rest pivotally linked to the frame and the framework, said linkage means supports a seat and a back rest portion for movement by body pressure from a sitting position into an inclined reclining position, and at the same time for movement of the foot rest from a stowed position fully folded under the seat and back rest portion into an elevated supporting position;

two arm portions fixedly connected to the framework to remain in unchanged position when pivoting the seat and back rest portion, wherein the linkage means forms a composite crank gear having a first gear train which includes the frame, an angle lever linked to the framework, a pivot arm and a first lever centrally and hingedly connected to the pivot arm, one arm of the first lever being connected to the frame, and having a second gear train which includes the frame, the first lever, a first longitudinal connecting rod, and the foot rest hingedly connected to one end of the first and a second longitudinal connecting rod, wherein the first longitudinal connecting rod is hingedly connected at one end thereof to a rotary point of a second lever and at another end thereof to another arm of the first lever, and wherein another end of the second of the two longitudinal connecting rods is hingedly connected to another arm of the second lever.

3. A rest chair comprising:

a seat portion pivotally supported at a foot portion around a horizontal axis;

a foot rest hingedly connected to the seat portion to be pivoted about a horizontal axis from a position folded under the seat portion into an unfolded foot supporting position; means for adjusting the seat portion in height with respect to the foot portion, and means including a back rest portion supported at the seat portion for pivoting about a horizontal axis; the seat portion and the foot rest being hinged together in such manner that the seat portion and the foot rest are pivotally adjustable together in response to body pressure; and means including a single control lever for controlling the pivotal adjustment of the back rest portion and the height adjustment of the seat portion.

4. A rest chair as claimed in claim 3, wherein the means including the control lever can selectively be operated in blocking position fixing the back rest portion with respect to its inclination and the seat portion with respect to its height, and in a first release position in which the inclination position of the back rest portion is unblocked, and in a second release position in which the height adjustment of the seat portion is unblocked.

5. A rest chair as claimed in claim 4, wherein in the first release position of the control lever a first auxiliary force device including a first gas spring acts against the pivot movement of the back rest portion about the horizontal axis, and wherein in the second release position of the control lever a second auxiliary force device including a second gas spring acts against height adjustment of the seat member in the vertical axis.

6. A rest chair as claimed in claim 5 comprising:

means including a shoulder element responsive to the control lever in the first release position to unblock the first gas spring.

7. A rest chair as claimed in claim 5 comprising:

means including a pulling member and an intermediate lever responsive to the control lever in the second release position to unblock the second gas spring.

8. A rest chair as claimed in claim 3, wherein the back rest portion is linked to a frame of the seat portion via a web and a gas spring, and wherein the control lever is connected pivotally about a horizontal axis at the frame of the seat portion laterally thereto.

9. A rest chair, comprising:

a seat portion pivotally supported at a foot portion about a horizontal axis;

a foot rest hingedly connected to the seat portion to be pivoted about a horizontal axis from a position folded under the seat portion into an unfolded foot supporting position;

means including linkage coupling a frame of the seat portion to a framework of the foot portion wherein the foot rest being pivotally coupled to the frame and to the framework through the means including linkage; said means including linkage forms a composite crank gear having a first gear train including the frame, a connecting rod connecting the framework with the frame and a first lever, the rotary point of which being arranged at a bracket fixed at the framework, and one arm of which is linked to the frame, and a second gear train including the frame, the first lever, a first longitudinal connecting rod, a second lever, a second longitudinal connecting rod and the foot rest hingedly connected to the one end of the first and second longitudinal connecting rods, wherein the first longitudinal connecting rod is hingedly connected at an intermediate position to a rotary point of the second lever and at its other end with the other arm of the first lever, and wherein the second longitudinal connecting rod is hingedly connected with its other end to the other arm of the second lever; the seat portion and the foot rest being hinged together in such manner that the seat portion and the foot rest are pivotally adjustable together in response to body pressure.

10. A rest chair as claimed in claim 9, wherein the connecting rod, the first lever, the bracket, the second lever and the two longitudinal connecting rods exist in pairs.

11. A rest chair, comprising:

a seat portion pivotally supported at a foot portion about a horizontal axis;

a foot rest hingedly connected to the seat portion to be pivoted about a horizontal axis from a position folded under the seat portion into an unfolded foot supporting position;

means for adjusting the seat portion in height with respect to the foot portion, and means including a back rest portion supported at the seat portion for pivoting about a horizontal axis;

means including linkage coupling a frame of the seat portion to a framework of the foot portion wherein the foot rest is pivotally coupled to the frame and to the framework through the linkage, said means including linkage forms a composite crank gear having a first gear train including the frame, a connecting rod connecting the framework to the frame and a first lever, the rotary point of which being arranged at a bracket fixed to the framework and one arm of which is linked to the frame, and having a second gear train including the frame, the first lever, a first longitudinal connecting rod, a second lever, a second longitudinal connecting rod and the foot rest hingedly connected with the one end of the first and second longitudinal connecting rods, wherein the first longitudinal connecting rod is hingedly connected at an intermediate position with a rotary point of the second lever and at its other end with the other arm of the first lever, and wherein the second connecting rod is hingedly connected with its other arm to the other arm of the second lever, the seat portion and the foot portion being hinged together in such manner that the seat portion and the foot rest are pivotally adjustable together in response to body pressure.

12. A rest chair as claimed in claim 11, wherein the connecting rod, the second lever, the bracket, the second lever and the two longitudinal connecting rods exist in pairs.

13. A rest chair having a framework supported on a foot member and including a frame for holding a seat and back rest portion linkage means pivotally connecting the frame to the framework, and a foot rest pivotally linked to the frame and the framework, said linkage means supports the seat and the back rest portion for movement by body pressure from a sitting position into an inclined reclining position, and at the same time for movement of the foot rest from a stowed position fully folded under the seat and back rest portion into an elevated supporting position;

two arm portions fixedly connected to the framework to remain in unchanged position when pivoting the seat and back rest portion; and a tensile spring structurally disposed to exert a preload force in the sitting position as well as in the reclining position of the rest chair to oppose the force to be exerted thereon by varying the sitting position by body pressure.

* * * * *